US006241454B1

(12) United States Patent
Ruf

(10) Patent No.: US 6,241,454 B1
(45) Date of Patent: Jun. 5, 2001

(54) LIFT TRUCK VEHICLE, WITH A POSITIONING MEANS

(76) Inventor: Hans Ruf, Tussenhausener Strasse 6, 86874 Zaisertshofen (DE)

( * ) Notice: Subject to any disclaimer, the term of this patent is extended or adjusted under 35 U.S.C. 154(b) by 0 days.

(21) Appl. No.: 09/505,780

(22) Filed: Feb. 17, 2000

(30) Foreign Application Priority Data

Mar. 29, 1999 (EP) ..... 99810268

(51) Int. Cl.[7] ..... B66F 9/14

(52) U.S. Cl. ..... 414/667; 414/671; 187/227

(58) Field of Search ..... 254/2 R, 2 C; 187/227, 222, 229, 234, 232; 414/663, 664, 667, 671, 785, 607

(56) References Cited

U.S. PATENT DOCUMENTS

| | | | | |
|---|---|---|---|---|
| 1,878,995 | | 9/1932 | Abbe . | |
| 3,050,206 | | 8/1962 | McCracken . | |
| 3,289,872 | | 12/1966 | Peratoner et al. . | |
| 3,323,664 | | 6/1967 | Loef et al. . | |
| 3,850,322 | | 11/1974 | Miles et al. . | |
| 4,290,729 | | 9/1981 | Cary . | |
| 4,533,290 | * | 8/1985 | Hackauf | 414/667 |
| 4,688,981 | | 8/1987 | Ravnsborg et al. . | |
| 4,756,661 | * | 7/1988 | Smart | 414/667 |
| 4,761,842 | | 8/1988 | Weiner . | |
| 4,949,816 | * | 8/1990 | Brown et al. | 187/227 |
| 5,401,134 | * | 3/1995 | Habicht et al. | 187/227 XV |

FOREIGN PATENT DOCUMENTS

| | | | | |
|---|---|---|---|---|
| 30 17 456 | | 11/1981 | (DE) . | |
| 296 06 840 | | 8/1996 | (DE) . | |
| 0 283 637 | | 1/1988 | (EP) . | |
| 0 572 864 | | 5/1993 | (EP) . | |
| 2-178200 | * | 7/1990 | (JP) | 187/227 |
| 3-138298 | * | 6/1991 | (JP) | 414/667 |

OTHER PUBLICATIONS

International Search Report.

* cited by examiner

*Primary Examiner*—Frank E. Werner
(74) *Attorney, Agent, or Firm*—Shoemaker and Mattare, Ltd.

(57) ABSTRACT

A lift truck vehicle (F) with a lift device (4) which comprises a positioning device (6) which is inclined with respect to the vertical. The positioning device (6) serves the setting up of the carrier fork (5) (or related device) independently of the lift device (4). The positioning device (6) is arranged over the front axle (9*a*) of the vehicle (F). The lift mast (3) is mounted laterally displaced behind the front axle (9*a*). The invention thus achieves optimal viewing conditions, particularly on loading the carrier fork (5) at half the height, and simultaneously an improved position of the center of gravity of the vehicle (F).

9 Claims, 2 Drawing Sheets

LIFT TRUCK VEHICLE, WITH A POSITIONING MEANS

BACKGROUND OF THE INVENTION

The industrial handling of goods, in particular palleted goods requires suitable machines for movement and for storage of these goods. Lift truck vehicles, in particular fork lift trucks with a drivers seat are known and common in the most varied of embodiment forms. The function results in the fact that on receiving and discharging the load of the fork lift truck with the load at the front one must drive frontally onto the respective loading position. The whole device for moving or lifting the load at the same time hinders the view of the driver. Proceeding from this problem the state of the art knows a number of improvements which are aimed at the design of the lift device on the fork lift truck. The lift device consists very generally of a mast mounted in front of the driver's cabin, often designed as a frame-shaped double mast, on which by way of rails or a telescopic device the carrier fork may be vertically lifted. Furthermore on the mast there are mounted the hydraulics required for this or a chain mechanism. The carrier fork consists of end-face surface formed by support members and the horizontal carrier arms or prongs arranged vertically to this, on which the load lies. The carrier fork thus mostly has an L-shape; the vertical end-face surface serves for the fastening on the lift device of the lift mast.

EP 283 637 and DE 296 06 840 describe technical solutions which are aimed at reducing the cross sectional profile of the carrier fork, which lies in the line of vision of the driver. In EP 283 637 there is described the integration into the lift rod of the hydraulics required for lifting the load. The carrier fork with this is conventional, i.e. with the end-face surface upright and fastened on the lift mast transversely to the longitudinal axis of the vehicle. The lift mast is attached on the front side of the vehicle, in front of the wheel axis.

DE 292 06 840 shows an individual lift mast of a small width attached centrally in the front of the vehicle. The inner profile of this serves as a guide rail for a carriage and the carrier fork fastened to the end-face surface.

EP 572 864 suggests a modified arrangement of the lift device. Instead of a conventional fork with a lift device fixedly fastened on the fork lift truck a complicated displacement fork carried via several axes is provided, which a enables lateral loading of the load. With this the actual lift mast is integrated laterally at the front into the carrier fork and thus is removed from the field of view of the driver. Disadvantageous with this is the handling by way of the additional joint axes. By way of the additional lever arms the allowable carrying load is reduced. The lifting height is low.

WO 88/0656 describes a design principle which displaces the lift mast into the rear part of the fork lift truck. The telescopic lift device is designed conventionally with an upright lift mast which however is mounted behind the vehicle cabin and in front of the rear axis of the vehicle. Extendible horizontal transverse carriers connect this lift device to the actual carrier fork which is mounted in front of the driver's cabin in the front of the vehicle. The fastening of the carrier fork on the lift device is effected by the vertically arranged end-face surface of the carrier fork. The viewing impediment to the driver by way of the lift system is alleviated, but not the viewing impediment by way of elements which are attached to the actual carrier fork. Furthermore the system during use does not permit the leaving of the driver cabin. Advantageously the arrangement of the lift mast is in the rear part of the vehicle so that an improved position of the center of gravity with an accommodated load is achieved.

Basically common to all these described solutions is that they do not alleviate the viewing impediment to the driver by way of the vertical end-face surface of the carrier fork, in particular by way of carrier forks with additional devices attached thereto. Such additional devices are above all positioning aids with whose help the arms of the carrier fork may be laterally adjusted relative to the vehicle or by way of which the relative distance of the arms of the carrier fork may be decreased or increased. Such a device in technical jargon is called a fork lateral displacer or prong adjusting means. The positioning means are mostly hydraulically operated, are attached individually or in combination and are integrated together with additional guide elements into the carrier fork, and specifically into the vertical end-face surface. The fork lift trucks known from the sate of the art are chiefly used for the loading and unloading of platform truck transporters (lorries) in warehouses or production facilities. On loading it is exactly at the platform truck height that the view is considerably compromised by way of the standard designs of the carrier fork with a vertical end-face surface, according to the state of the art.

SUMMARY OF THE INVENTION

According to the invention this object is achieved as described below. With this the positioning means is inclined towards the horizontal and the lift mast is placed behind the front axle. As a positioning means within the meaning of the patent claims with this there applies the whole constructional unit of hydraulic elements, guide and support elements which connect the arms of the carrier device to the lift mast. The outer bordering of the positioning means has in cross section roughly the shape of a rectangle. The longitudinal side is arranged transversely to the travel direction of the lift truck. By way of this according to the invention there results a flat mounting of the positioning unit, which is inclined to the horizontal. The angle of inclination a is at least 30°. The advantage of this arrangement is that the positioning means blocks the view forward to a lesser extent. According to the invention this permits the displacement of the lift mast behind the front axle towards the middle of the vehicle. The lift mast arranged behind the front axle and the positioning means do not act as a load in front of the axle, by which means the position of the center of gravity is improved. Assuming a vehicle of the conventional type with 3.5–5 tons lift force and a mast weight of 9000 kg, the weight saving may be 25% of the lift force. The lift truck vehicle may thus be constructed smaller or the counterweight may be smaller. This improves the manouvrability of the vehicle e.g. in narrow warehouses, as well as the acceleration and the fuel consumption. Furthermore by setting back the lift mast laterally to the rear, and with a compact design of the lift mast with an inner lying hydraulic lift device according to the state of the art, the field of view of the driver is decisively enlarged, in particular forwards in the direction of travel.

A positioning means within the concept of this invention includes mechanical and hydraulic devices as are necessary for prong adjusting apparatus, side loaders, barrel and bale tongs, tong forks or a combination of such functions. A side loader permits the lateral displacement of the carrier device relative to the vehicle. This permits an exact fine positioning of carrier arms, without having to change again the vehicle position. An adjusting device for individual arms of the carrier device relative to one another permits an exact adaptation of the carrier device to the load, e.g. to the lower side guiding of pallets.

Both mentioned positioning means are in practise useful and common, but however require a multitude of additional components. With these components it is a case primarily of telescopic or support members as well as hydraulic cylinders. The entirety of these elements is arranged in a rectangular cross section and forms the positioning means. The individual components may with this, disregarding connections required for the functioning, lie open, be grouped together in a frame or lagged with viewing apertures. Only the arrangement according to the invention, permits the viewing impediment by way of the latter, in particular on loading a lorry at half the height to be reduced.

Advantageously the positioning means is mounted at an angle of more than $\alpha=60°$ between the vertical of the lift mast and the longitudinal axis of the positioning means, since then the profile of the positioning means lying in the viewing angle has a very small cross sectional surface.

Advantageously an additional, preferably vertical connection element connects the arms of the carrier device and the positioning means. The driver has thus with a loading at half the height a free view of the fork arms whilst the positioning means is located above outside the viewing direction. This feature of the invention is fulfilled also by every other arrangement, of this connection element, which deviates from the vertical as long as it effects a vertical relocation of the positioning means in relation to the arms of the carrier device.

Advantageously a positioning means arranged in such a manner is arranged over the front axle in order thus neither to increase the lever effect of the load accommodated by the carrier device by way of the extension in the direction of the longitudinal axis of the vehicle nor by its intrinsic weight. The load with this is taken up by the front wheels. The arrangement according to the invention of the positioning means thus improves the view forwards as well as also the position of the center of gravity of the vehicle.

A carrier device within the concept of this invention includes one or several arms which with one side are fastened on the positioning means and, arranged parallel, point forward in the longitudinal direction of the vehicle. Usually it is the case of a carrier fork with at least two prongs of a rectangular cross section which permit the simple transport of goods loaded on pallets. According to the invention the carrier device may also be formed as barrel or bale tongs, a carrier spike or also as a similar gripping or support device as are usually applied with fork lift trucks.

A positioning means in the context of this invention, with respect to the arrangement according to the invention on the vehicle will have a considerably larger longitudinal extension (in the direction of the vehicle longitudinal axis) than the height. Preferably the ratio length:height is 3:1 to 7:1.

A preferred embodiment form of the invention is a fork lift truck with a flat positioning aid mounted over the front axle and a single lift mast laterally displaced behind the front axle. With larger lift forces a second lift mast may be attached on the opposite vehicle side, symmetrically to the first one. The fork lift truck has as a rule two front wheels. However also embodiment forms with one front wheel are known. The mast as a rule is arranged vertically. However also slightly inclined mast arrangements are known. The invention is hereinafter described in more detail in an embodiment example by way of drawings.

DESCRIPTION OF THE PREFERRED EMBODIMENT(S)

Figure 1:
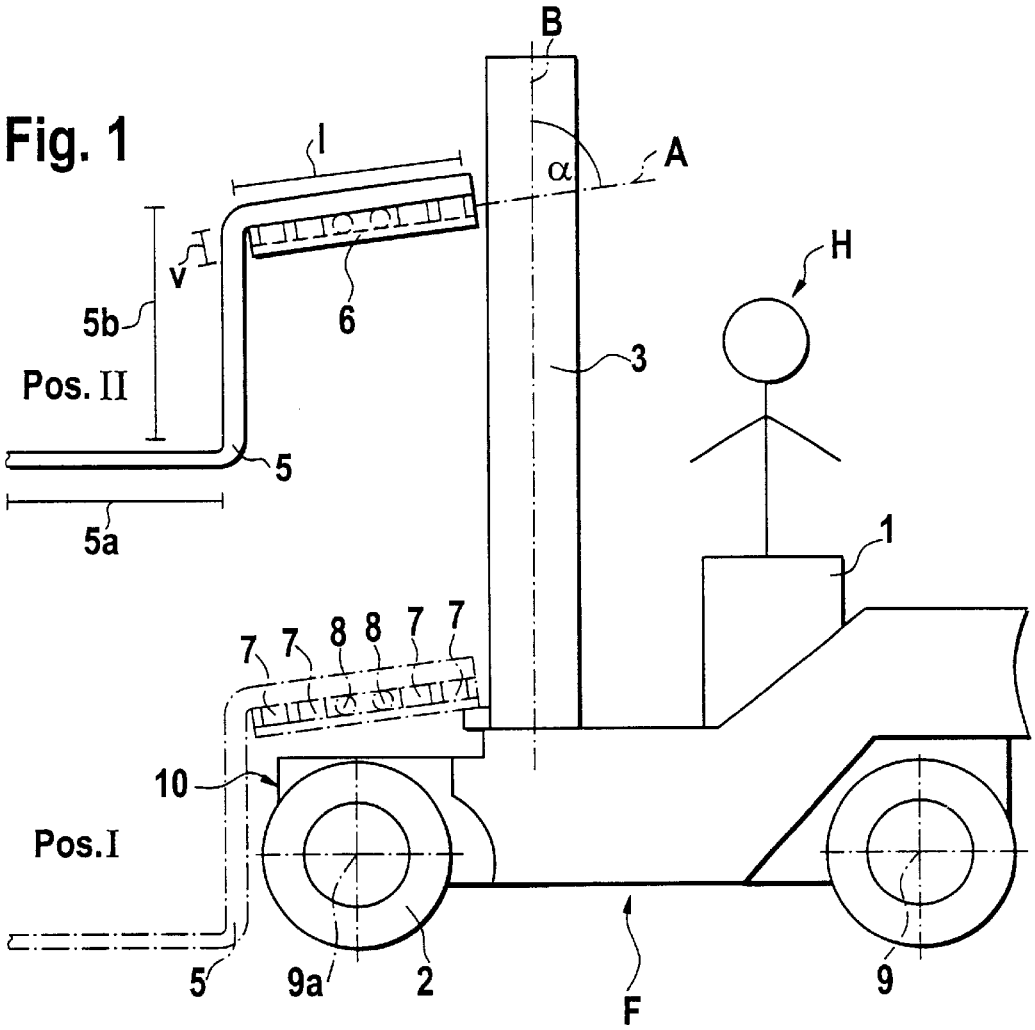
FIG. 1 is a lateral view of the vehicle with an arrangement of the elements of the lifting system.

FIG. 1 shows the lateral view of a lift truck vehicle F with the features of the invention. It is the case of a four-wheeled design with two wheels 2 arranged on the front side and parallel. An operating unit 1 for a driver H is in the middle of the lift truck vehicle F. A vertically arranged lift mast 3 which serves the guiding of a carrier fork 5 is placed behind the front rotating axle 9*a*. A conventional hydraulic lift unit 4 is preferably integrated into the mast. Fastened on the lift mast 3 or the lift unit 4 there is located a carrier fork 5 which projects forwards beyond the end-face side 10. The carrier fork 5 is either shown in the lifted position I as well as in the lowest opposition II. The head height of the driver H is shown, in order to emphasise the free viewing of the carrier arms 5*a* which is achieved with the embodiment example, with the carrier lever 5 lifted to half height. A positioning aid 6 comprises all elements which are necessary for a hyraulic adjustment of the carrier arms 5*a*, specifically the hydraulic cylinder 8 and the adjustable support members 7. The horizontal part of the carrier fork 5, the carrier arms 5*a*, is connected by a vertical element 5*b* to the positioning aid 6. The positioning aid 6 is flatly inclined at an angle of $\alpha=60°$ from the vertical B relative to its longitudinal axis A. It serves then as a connection element of the carrier arms 5*a* to the lift mast 3.

Figure 2:
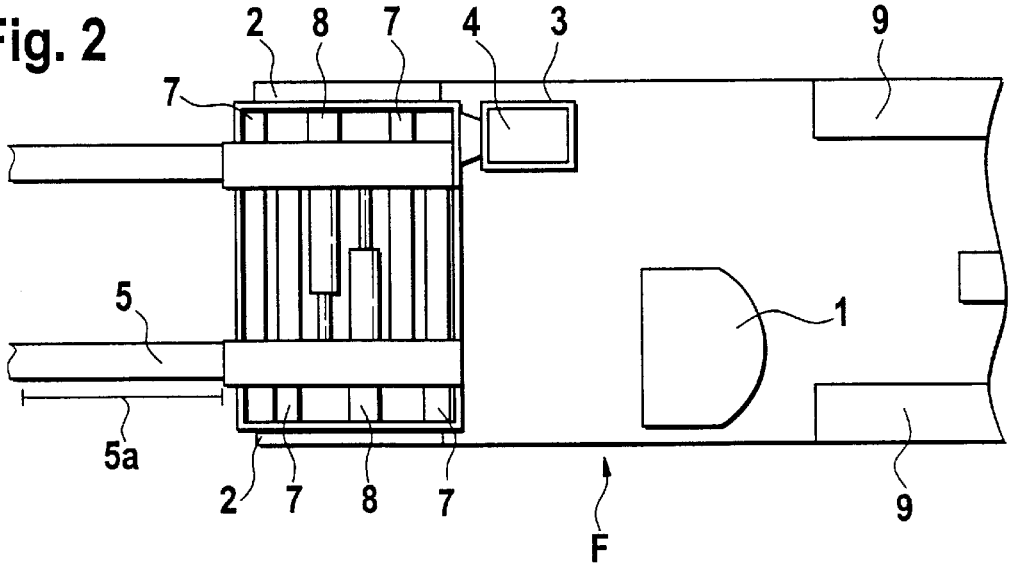
FIG. 2 is a plan view of the vehicle.
Figure 3:
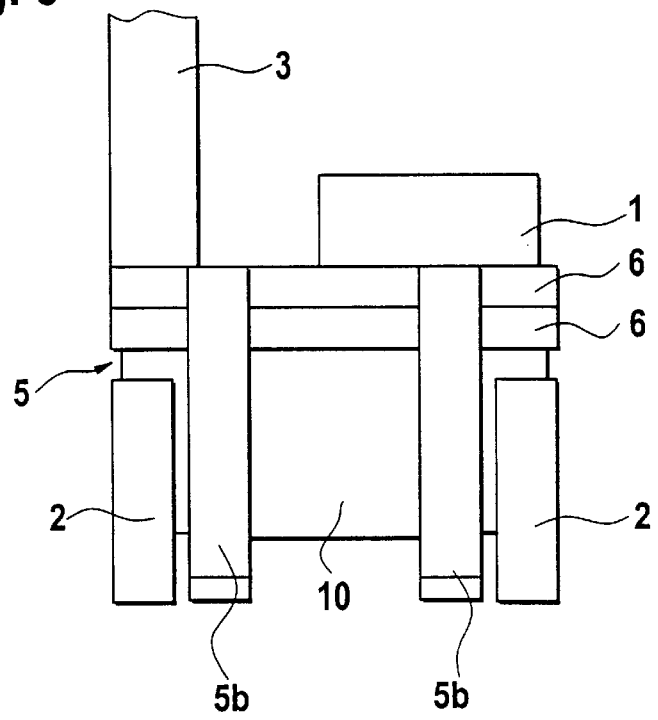
FIG. 3 is a front view of the vehicle and FIG. 4 is a positioning means in a cutout.

FIG. 2 shows a plan view of the lift truck vehicle F according to FIG. 1. In the plan view the lift mast 3 is arranged laterally displaced from the longitudinal axis A of the vehicle in the front region, specifically between the operating unit 1 and the front axle 9*a*. By way of this an improved position of the center of gravity is achieved. Simultaneously the lift mast is removed from the field of view of the driver H. According to the invention the lift truck vehicle F has at least one lift mast 3. With this embodiment the operating unit 1 of the driver H should also be arranged displaced from the longitudinal axis (with a two-mast embodiment it should be mounted roughly in the middle). The arrangement of the elements, the lift mast and the operating unit 1 of the driver H for a one-mast embodiment is again represented in FIG. 3, a front view of the vehicle F according to FIGS. 1 and 2.

In this representation the low cross sectional profile of the positioning means in the direction of travel is emphasised. According to FIG. 1 a main advantage of the invention is the free view which is given to the driver H by way of the flat arrangement of the positioning aid 6 onto the carrier arms 5*a*. The positioning aid 6 only faces the driver with its narrow side 8. It is inclined about $\alpha=60°$ relative to the vertical B. Additionally the horizontal carrier arms 5*a* of the carrier fork 5 are offset downwards from the positioning means 6 by way of a vertical element 5*b*.

Figure 4:
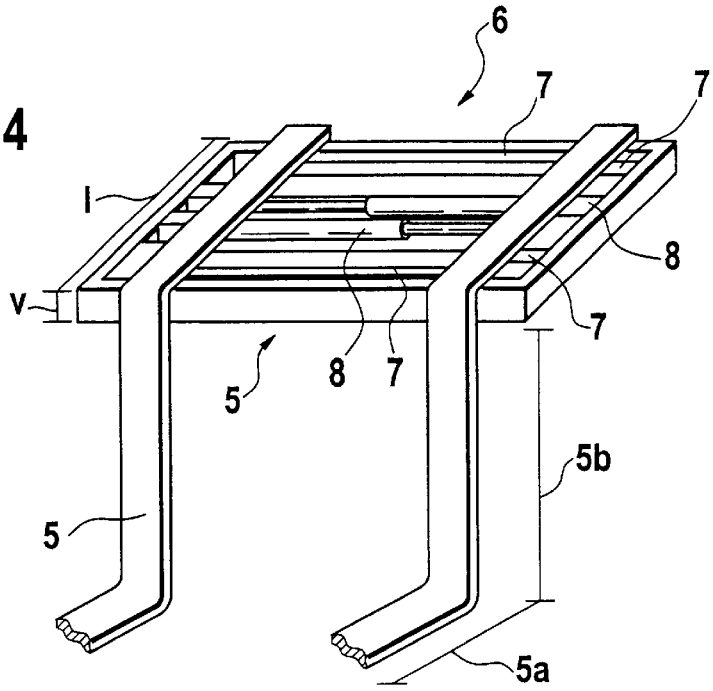

FIG. 4 shows the positioning means 6 in a cutout and in a slightly enlarged representation with the carrier fork 5 in a semi-profile. The longitudinal extension 1 of the positioning means which is larger than the height v by a factor of 8 is thus clear. Above all the invention may also be realised with small ratios of v:1. Above all also ratios of 1:3 to 1:6 have proven themselves. The angle of inclination a between the longitudinal axis of the positioning means A and the vertical B is for the purpose of an improved representation changed with respect to the previous FIGS. 1 to 3. The elements of the positioning means 6, adjustable support members 7 and the hydraulic cylinder 8 form a rectangular cross section. The shown embodiment example is that of a clamp fork. The invention of course is not limited to the embodiment form described in the figures which only have an exemplary character.

What is claimed is:

1. A lift truck vehicle comprising an operating unit for a driver, wheels with rotating axles, including at least one front wheel mounted neighboring an end-face side of the operating unit, at least one lift mast which is mounted behind a rotating axle of at least one front wheel in a direction towards the vehicle center, and a lift unit for lifting a carrier device in a vertical direction along said lift mast, wherein said carrier device is fastened to and lies in a plane at approximately a right angle to the lift unit by way of a positioning means, said lift mast is mounted laterally displaced to one side of a longitudinal center plane of the vehicle and in front of said operating unit, and the positioning means, in a longitudinal direction of the vehicle, has a larger extension than in a vertical direction and in its longitudinal direction is forwardly and downwardly inclined at an angle to a vertical axis of the lift mast in order to enhance forward visibility of the driver.

2. A lift truck vehicle according to claim 1, wherein the positioning means is adapted for the lateral adjustment of the carrier device.

3. A lift truck vehicle according to claim 1 wherein the positioning means is adapted for the relative displacement of arms of the carrier device.

4. A lift truck vehicle according to claim 3, wherein the positioning means comprises hydraulic adjusting means, made up of piston arrangements.

5. A lift truck vehicle according to claim 1, wherein the longitudinal direction of the positioning means is inclined at an angle of more than 60° to the vertical axis of the mast.

6. A lift truck vehicle according to claim 1, wherein between the positioning means and carrier arms there is provided a substantially vertically arranged connection element.

7. A lift truck vehicle according to claim 1, wherein the positioning means is arranged above the at least one front wheel.

8. A lift truck vehicle according to claim 1, wherein the carrier device comprises a carrier fork.

9. A lift truck vehicle according to claim 1, wherein a length of the positioning means is at least 3 times larger than a height in the vertical direction.

* * * * *